US005634361A

United States Patent [19]

Herschman et al.

[11] Patent Number: 5,634,361

[45] Date of Patent: Jun. 3, 1997

[54] APPARATUS AND METHOD FOR STRAIGHTENING DAMAGED OR BENT WHEELS

[75] Inventors: George J. Herschman, Bath; Daryl L. Robbins, Chadds Ford, both of Pa.

[73] Assignee: Advanced Machine Systems, Bath, Pa.

[21] Appl. No.: 248,269

[22] Filed: May 24, 1994

[51] Int. Cl.[6] ..... B21D 1/10

[52] U.S. Cl. ..... 72/31.02; 72/68; 72/69; 72/342.1

[58] Field of Search ..... 72/26, 30, 34, 72/69, 316, 342.1, 31.02; 29/894.324, 894.35, 894.353, 894.354

[56] References Cited

U.S. PATENT DOCUMENTS

| | | | |
|---|---|---|---|
| 852,829 | 5/1907 | Einfeldt . | |
| 1,367,818 | 2/1921 | Kennedy . | |
| 1,489,151 | 4/1924 | Prossen . | |
| 1,548,521 | 8/1925 | Fowler . | |
| 1,550,651 | 8/1925 | Charter . | |
| 1,556,996 | 10/1925 | Johnson . | |
| 1,647,221 | 11/1927 | Bushek . | |
| 1,650,216 | 11/1927 | Ingham . | |
| 1,651,111 | 11/1927 | Winter . | |
| 1,785,923 | 12/1930 | Wade | 72/342.1 |
| 1,786,847 | 12/1930 | Hunt . | |
| 1,832,529 | 11/1931 | Carlson | 72/34 |
| 2,054,248 | 9/1936 | Eronen . | |
| 2,102,439 | 12/1937 | Schildmeier | 72/311 |
| 2,105,289 | 1/1938 | Lobdell, Jr. . | |
| 2,126,526 | 8/1938 | Arnholm . | |
| 2,179,992 | 11/1939 | Champayne . | |
| 2,244,927 | 6/1941 | Vanstone et al. . | |
| 2,360,171 | 10/1944 | Smith . | |
| 2,368,377 | 1/1945 | Phillips | 72/342.1 |
| 2,718,253 | 9/1955 | Zinke . | |
| 2,767,764 | 10/1956 | Smith . | |
| 3,065,780 | 11/1962 | Romak . | |
| 3,114,493 | 12/1963 | Textor, Sr. . | |
| 3,120,774 | 2/1964 | Johnson et al. . | |
| 3,143,377 | 8/1964 | Bulgrin et al. . | |
| 3,276,237 | 10/1966 | Trausue . | |
| 3,555,875 | 1/1971 | Clark . | |
| 3,566,667 | 3/1971 | Hagerty . | |
| 3,625,046 | 12/1971 | Van Gompel . | |
| 3,636,614 | 1/1972 | Damman . | |
| 3,765,219 | 10/1973 | Easom, Jr. . | |
| 3,823,591 | 7/1974 | Schroeder et al. . | |
| 4,074,408 | 2/1978 | Davis . | |
| 4,143,449 | 3/1979 | Main et al. . | |
| 4,155,242 | 5/1979 | Peterson . | |

(List continued on next page.)

FOREIGN PATENT DOCUMENTS

| | | | |
|---|---|---|---|
| 3801104 | 8/1989 | Germany | 72/69 |

*Primary Examiner*—Lowell A. Larson
*Attorney, Agent, or Firm*—Seidel, Gonda, Lavorgna & Monaco, P.C.

[57] ABSTRACT

This invention provides methods and apparatuses for determining the non-true condition of a damaged metal wheel such as the wheel's radial runout, its lateral runout, and the length of its damaged zone. The invention provides for the use of components which rigidly hold the wheel in a fixture, which apply heat to the wheel in a controlled manner so as to raise the temperature of the wheel to its somewhat softened state, and which apply a suitable force to the damaged zone while the wheel is in its, or while it is being heated, to its somewhat softened state. This force is applied to the heated wheel until the radial runout of the damaged zone is reduced to a first predetermined limit. The invention also provides for the use of components which rotate the wheel between at least a pair of oppositely-positioned contacting and compressing rollers. This compression action occurs after the wheel has been heated to its, or while it is being heated to its, somewhat softened state. This heating process is performed in a controlled manner. The application of heat and the rotation of the wheel continues until the radial runout is reduced to a second predetermined limit. The second predetermined limit is closer to the wheel's original true condition than is the first predetermined limit.

10 Claims, 8 Drawing Sheets

U.S. PATENT DOCUMENTS 4,197,706 4/1980 Blake .
4,296,626 10/1981 Jarman et al. .
4,333,330 6/1982 Porter .
4,392,263 7/1983 Amoroso .
4,653,167 3/1987 Mullins .
4,700,559 10/1987 Larson et al. .
4,754,636 7/1988 O'Dell .
4,776,196 10/1988 Cudini .
4,802,358 2/1989 Cavaca .
4,848,136 7/1989 Venäläinem .
4,897,909 2/1990 LaVoy .
4,986,102 1/1991 Hendrickson et al. .
5,036,695 8/1991 Bergeron .
5,065,609 11/1991 Dischler .
5,070,600 12/1991 Brew et al. .
5,111,681 5/1992 Yasui et al. .
5,125,256 6/1992 Ohkubo et al. .

APPARATUS AND METHOD FOR STRAIGHTENING DAMAGED OR BENT WHEELS

FIELD OF THE INVENTION

The present invention relates to the field of metal working. More particularly, it relates to apparatuses and methods for straightening deformed, bent or otherwise damaged wheels of automobiles, trucks, motorcycles and the like.

BACKGROUND OF THE INVENTION

Wheels are frequently bent or distorted out of shape as a result of an accident, or as a result of encountering a pothole in a road surface. Unless the bend is removed, uneven tire wear, vibration, air loss and/or bearing and suspension fatigue of the vehicle will most likely occur. Many wheels are formed of metals which are comprised of pressed steel and/or alloys (e.g., aluminum, titanium, etc.).

Numerous devices and machines are known for straightening the deformed wheel. Examples of such machines are described in U.S. Pat. No 2,767,764, U.S. Pat. No. 2,244,927 and U.S. Pat. No. 3,065,780. Most of the conventional machines used for this purpose employ a hydraulic press as a means for exerting forces against the surface of the wheel that possess the deformed condition.

Although such forces accomplish their intended purpose, they have a tendency of rupturing the wheel's surface. This rupturing may be particularly noticed on lightweight automotive wheels, such as those comprised of the aluminum alloys.

In view of the above, it can be seen that there is a present need for an improved apparatus, as well as a method, which can successfully straighten bent or otherwise damaged wheels. Such an improved apparatus and/or process must be able to repair a damaged wheel while reducing the degree of damage imparted onto the wheel's surface, as well as reducing the degree of damage imparted onto the wheel's structural integrity.

Accordingly, it is an object of the present invention to provide an apparatus and a method for straightening and/or repairing damaged wheels without adversely affecting the wheel's surface or its structural integrity.

It is a further object of the present invention to provide a wheel straightening machine, and a method for using the same, that are particularly suited for straightening and/or repairing lightweight metal alloy wheels.

Furthermore, it is an object of the present invention to provide an apparatus for straightening and/or repairing all types of wheels, as well as a method for operating such an apparatus, that may be performed in a manual, semi-automatic or automatic manner.

SUMMARY OF THE INVENTION

The present invention is directed to a means for straightening and/or repairing deformed, bent, or otherwise damaged wheels. Preferably, the means for making such a repair comprises the use of an apparatus which has at least two stations or machines. The first station is designed to restore a damaged wheel to its approximately true, original condition. On the other hand, the second station is designed to restore the damaged wheel to its nearly true, original condition.

The first station employs a pressure applying means (e.g., a hydraulic press) and does not attempt to restore the wheel to its nearly true condition. Rather, this station leaves such restoration to the second station that employs rollers and tooling plates to achieve a smoother and more accurate restoration of the wheel to its original roundness condition. The invention further comprises a process for straightening the wheel which may be practiced in a manual, semi-automatic or automatic manner.

The process for repairing wheels in accordance with the present invention generally comprises following the steps: (a) determining the extent of damage to the wheel, (b) rigidly holding the damaged wheel in a straightening apparatus, (c) applying heat to the wheel in a controlled manner, while the wheel is held in the straightening apparatus, and (d) applying suitable pressure to the heated wheel while the wheel is held in the straightening apparatus.

When determining the extent of damage to the wheel, at least the following parameters are examined: (a) the damage to the wheel, (b) its radial runout, (c) its lateral runout, and (d) the length of its damaged zone. While the damaged wheel is being rigidly held in the straightening apparatus, heat is applied to the wheel so as to raise its temperature to its somewhat softened state. Thereafter and/or simultaneously therewith, a force is applied to the damaged zone; thus, urging the wheel to return to its approximately true, original shape. Preferably, the process further comprises the step of rotating the rigidly-held wheel, while it is in its somewhat softened state, between oppositely-positioned compressing rollers or radial tooling member, until the wheel is transformed from its approximately true shape to its nearly true, original shape.

Other objects, advantages and novel features of the present invention will become apparent to those skilled in the art upon reading in the following detailed description when considered in conjunction with the appended claims and the accompanying drawings briefly described below.

BRIEF DESCRIPTION OF THE DRAWINGS

For the purpose of illustrating the invention, there is shown in the drawings various embodiments which are presently preferred. It should be understood, however, that this invention is not intended to be limited to the precise arrangements and instrumentalities shown therein.

FIGS. *6a* and *6b* are two examples of tooling members which can be used in a process to repair damaged wheels in accordance with the present invention.

Figure 2:
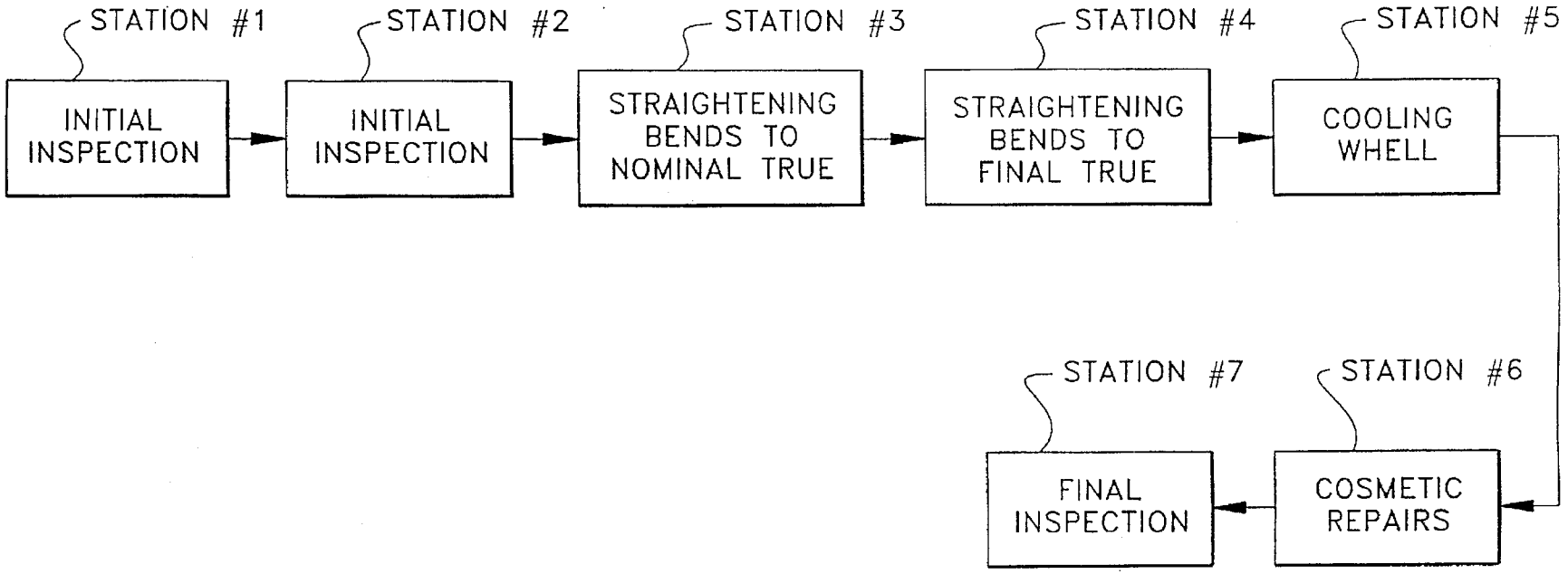
FIG. 2 is a block diagram illustrating sequential stations related to the wheel straightening process of the present invention.
Figure 7:
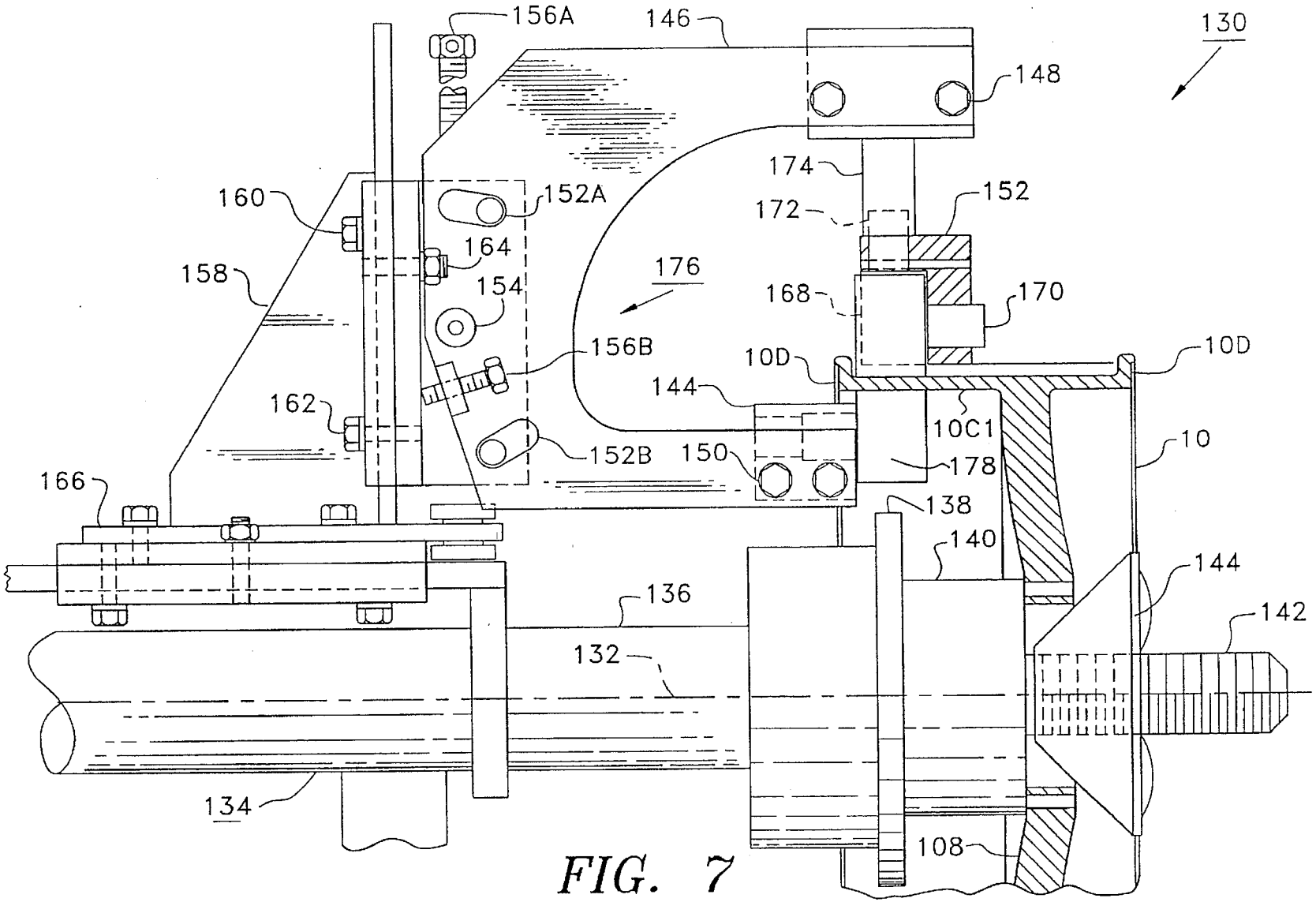

FIG. 7 is a side, partially cross-sectioned view of a machine which can perform the function in Station 4 of FIG. 2.

Figure 8:
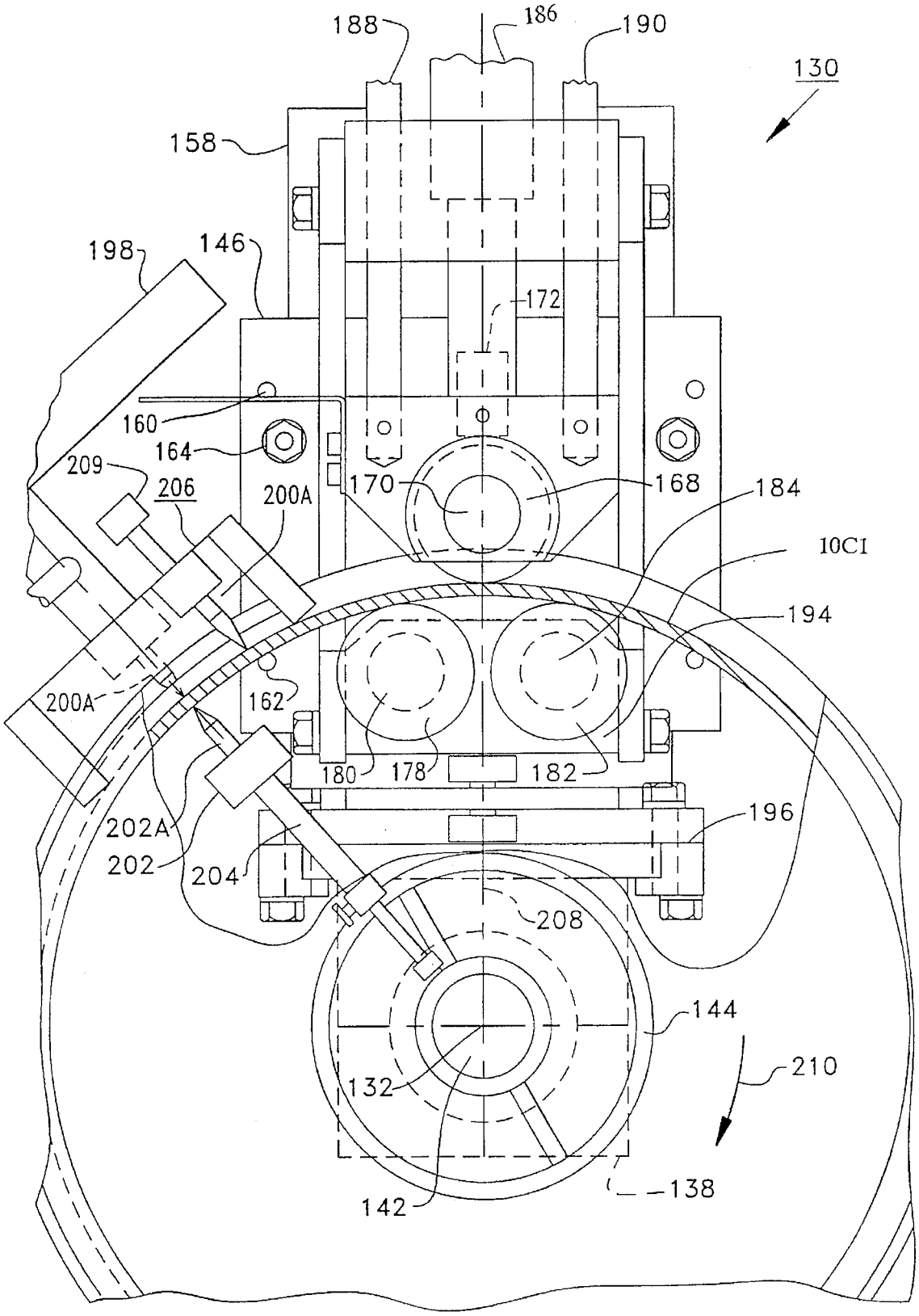

FIG. 8 is a front, partially cross-sectioned view of the machine illustrated in FIG. 7.

Figure 9:
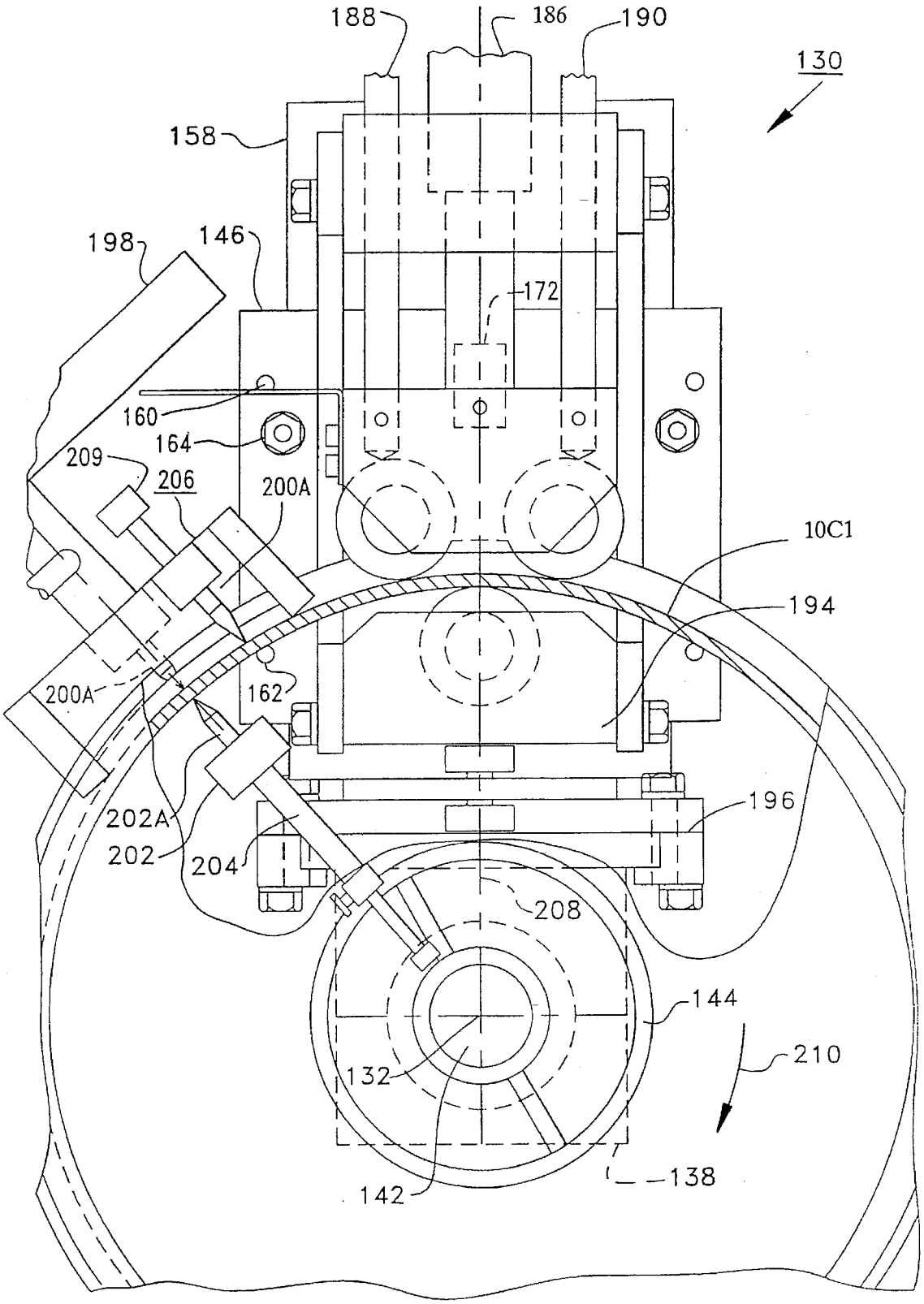
Figure 2:
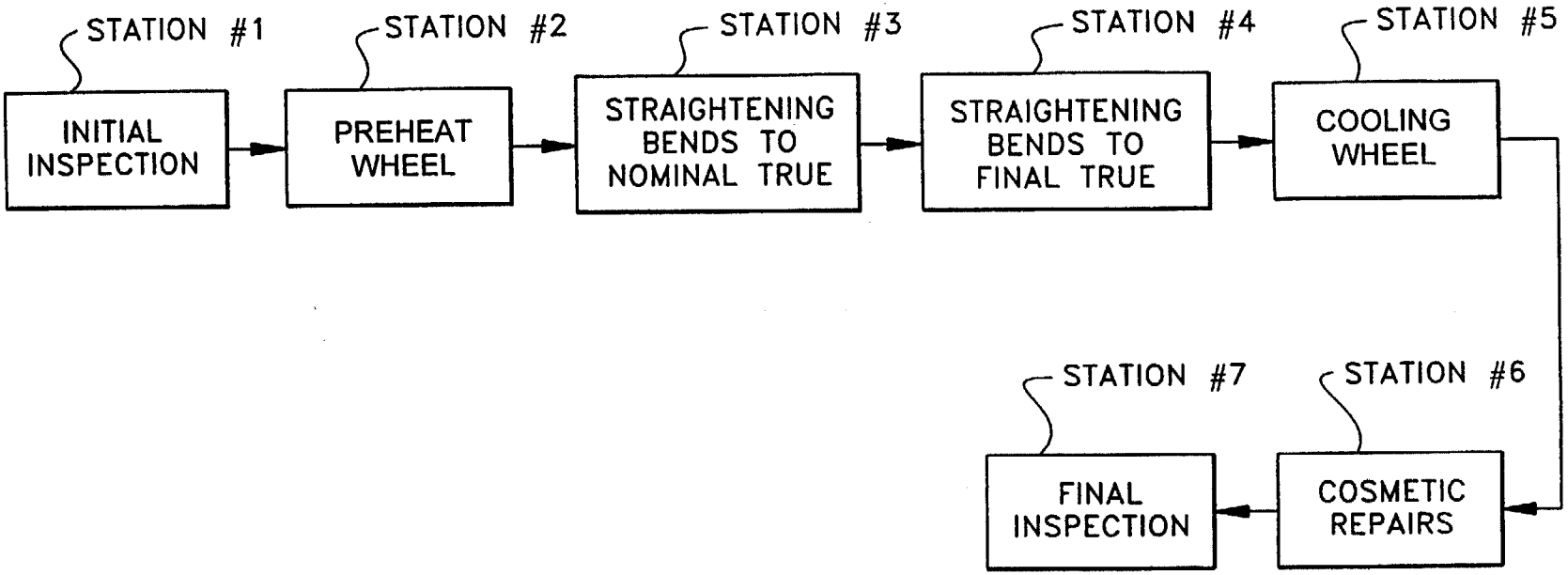
Figure 6B:
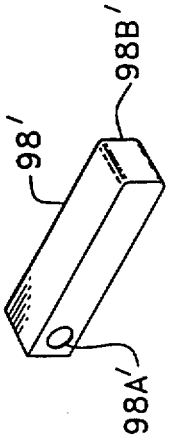
Figure 6A:
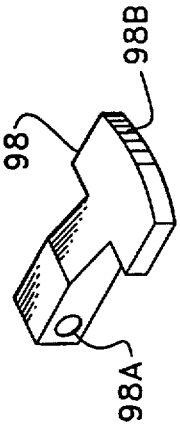

FIG. 9 is a front, partially cross-sectioned view of a machine which can perform the function in Station 4 of FIG. 2.

DEFINITIONS

As used herein, the term "somewhat softened gate" refers to a physical state of the wheel which is between its solid state and its molten state. Accordingly, a wheel is heated to its "somewhat softened state" when it is heated to a temperature which does not exceed the metal's melting point. Typically, when practicing this invention, the wheel is heated to a temperature which is greater than about 200° F. but less than at least 10° F. below the particular metal's melting point. For many types of wheels, heating the same to a temperature in the range from between about 200° F. to about 700° F. results in transforming the wheel from its solid state to its "somewhat softened state".

When a portion of a wheel is heated to its somewhat softened state in accordance with this invention, it is more susceptible to being molded when a pressure is exerted thereon. Typically, a wheel is heated to its somewhat softened state when a force ranging from between about 200 to about 6,000 pounds is necessary to deform its heated portion.

In other words, when practicing this invention, a wheel is deemed to be heated below its somewhat softened state if a force greater than about 6,000 pounds is necessary to deform it. Conversely, a wheel is deemed to be heated above its somewhat softened state if a force less than about 200 pounds can deform it.

DETAILED DESCRIPTION OF THE INVENTION

Figure 1:
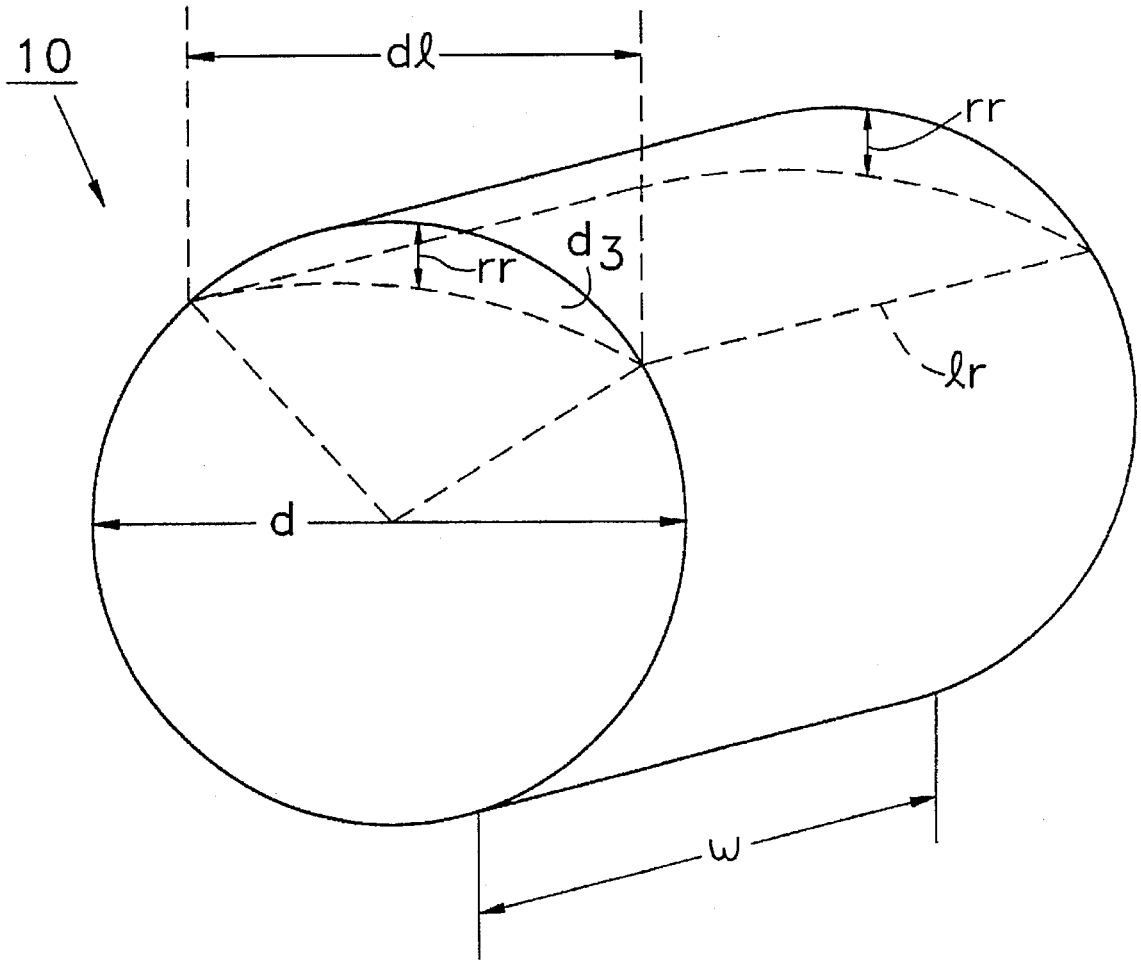
FIG. 1 is a schematic illustration showing some of the parameters of a damaged wheel which can be repaired by practicing the present invention.

For the purposes of discussion herein, an automotive wheel, or other types of wheels related to the present invention, have at least the parameters shown in FIG. 1. FIG. 1 illustrates a wheel 10, which has a specific diameter (d) associated therewith. Although this invention can be used to repair most types of vehicular wheels, this invention will generally be used to repair wheels which have a diameter ranging from between about 12 inches to about 24 inches, and more generally from between about 13 inches to about 17 inches.

Wheel 10 also has a specific width (w) associated therewith. Although this invention can be used to repair most types of vehicular wheels, this invention will generally be used to repair wheels which have a width ranging from between about 4 inches to about 15 inches, and more generally from between about 5 inches to about 12 inches.

FIG. 1 further shows that wheel 10 as having a damaged zone (dz) wherein the wheel is not in its "true" condition. As used herein, a wheel is said to be in its "true" condition when it has its original shape and/or "roundness."

Conversely, as used herein, a wheel which is not in its "true" condition is referred to as being in its "non-true" condition. This condition is sometimes referred to as a wheel which has a damaged, radial zone.

Further, as used herein, the "true" condition has a nominal condition that may vary somewhat from the actual or desired shape of the original wheel, and a final condition in which the wheel is substantially restored to its desired rounded-original-true shape that it possessed before it was dented or damaged. This condition is sometimes referred to as a wheel which has a non-damaged, radial zone.

As illustrated in FIG. 1, the damaged zone (dz) of wheel 10 has a damage length (dl), a radial runout (rr) present at the tire bead or lip of the wheel and a lateral runout (lr) that commonly causes the "wobble" of a damaged-rotating wheel. The wheel's damaged zone (dz) may be present at the front of the wheel (i.e., the portion facing outward from the vehicle) or at the rear of the wheel (i.e., the portion facing inward to the vehicle).

The process for straightening the wheel's damaged zone (dz) may be described with reference to FIG. 2. Specifically, FIG. 2 describes a plurality of sequential "stations", in each of which performs a desired function. These stations, and their respective functions, are described in Table 1 below.

TABLE 1

| Station # | Operation Being Performed |
|---|---|
| 1 | Initial inspection of the wheel to determine the wheel's parameters including the extent and location of the damages |
| 2 | Pre-heat wheel to its somewhat softened state in order to facilitate repairs |
| 3 | Returning the wheel to its nominal true condition while it is heated to its somewhat softened state |
| 4 | Returning the wheel to its final true condition while it is heated to its somewhat softened state |
| 5 | Cooling the repaired wheel |
| 6 | Cosmetically repairing the wheel |
| 7 | Final inspection of the repaired wheel |

Of the stations set out in Table 1, Stations 2, 3 and 4 are of particular importance to the present invention. Moreover, of these, Station 3 accommodates most of the needs of the present invention to restore the damaged wheel to its nominally-true condition, whereas Station 4 accommodates most of the needs of the present invention to restore the damaged wheel to its final-true condition.

Before the initial inspection at Station 1 is performed, the damaged wheel is preferably washed. Then in Station 1, an operator determines the wheel's various parameters. Examples of parameters determined by the operator in Station 1 include those set out in Table 2. It should be noted, however, that the apparatus can be programmed and/or designed to make some, if not all, of these determinations.

TABLE 2

| Wheel Parameters Inspected/Recorded |
|---|
| Wheel diameter (d) |
| Wheel (w) |
| Wheel type (e.g., steel, aluminum, other) |
| Temperature range necessary to heat wheel to its somewhat softened state |
| Radial runout (rr) of the damaged wheel |
| Lateral runout (lr) of the damaged wheel |
| Length of damage zone (dl) |
| Damage zone location (front/rear) (e.g., front and/or rear) |
| Non-structural, cosmetic damage (type and location, if any) |

The operation performed in Station 2 preheats the wheel so as to allow its metal to relax and, thereby, make it more amenable to the restoration process that is performed during the operations of Stations 3 and 4. When performing the function in Station 2, it is important to heat the wheel to a temperature which is at least 200° F. but below its melting point. As indicated earlier, this is referred to herein as heating the wheel to its "somewhat softened state."

The temperature at which this somewhat softened state occurs depends upon the material from which the wheel is made. Those skilled in the art would be able to determine the optimum preheating temperature range after reading this specification.

Any suitable heating device can be used for performing the function set out in Station 2. Examples of suitable heating devices include, without limitation, an oven, an open flame, a propane torch, an acetylene torch, heating coils and the like, and/or any combination thereof.

The actual wheel repairing process is carried out in Stations 3 and 4. A detailed description of one method for performing these functions will be described later in this specification.

The operation performed in Station 5 cools the repaired wheel so as to allow the metal to reclaim and restore the characteristics it possessed when it was in its non-heated condition. When performing the function in Station 5, it is presently preferred to use a cooling oven which is particularly suited for wheels so that such wheels may be slowly cooled to relieve any inherent stress that may have been built up during the processes performed in Stations 3 and 4. However, it is within the purview of this invention to cool the wheel by any suitable means known to those skilled in the art including, without limitation, air cooling.

Station 6 may, if necessary, use a lathe and/or a polisher to repair cosmetic damage affecting the appearance of the wheel.

Station 7 involves the final inspection of the wheel. If necessary, a final finishing can be performed which may include painting or applying a clear coat onto the repaired wheel.

Figure 3:
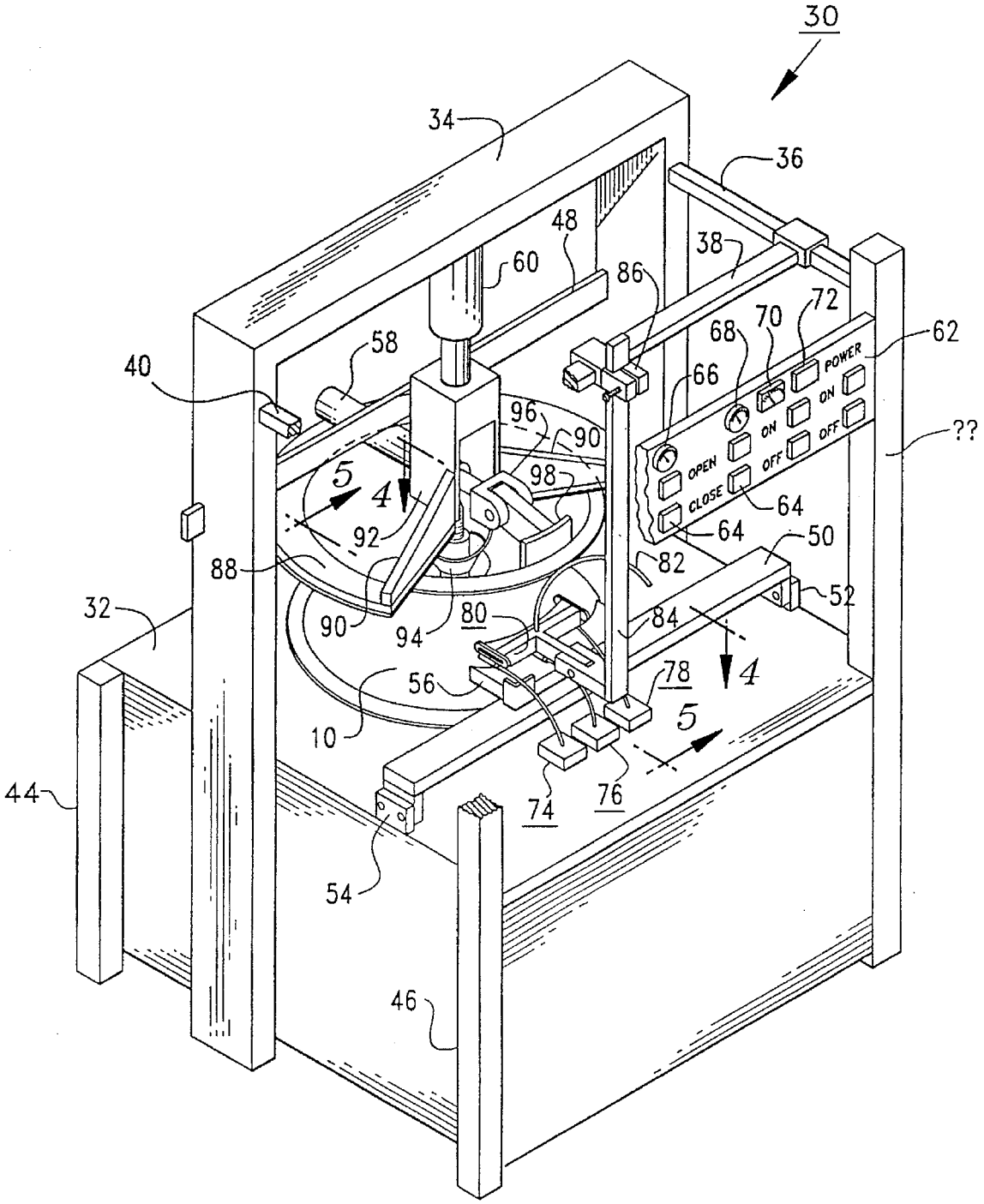
FIG. 3 is one embodiment of a machine which can perform the function in Station 3 of FIG. 2.
Figure 4:
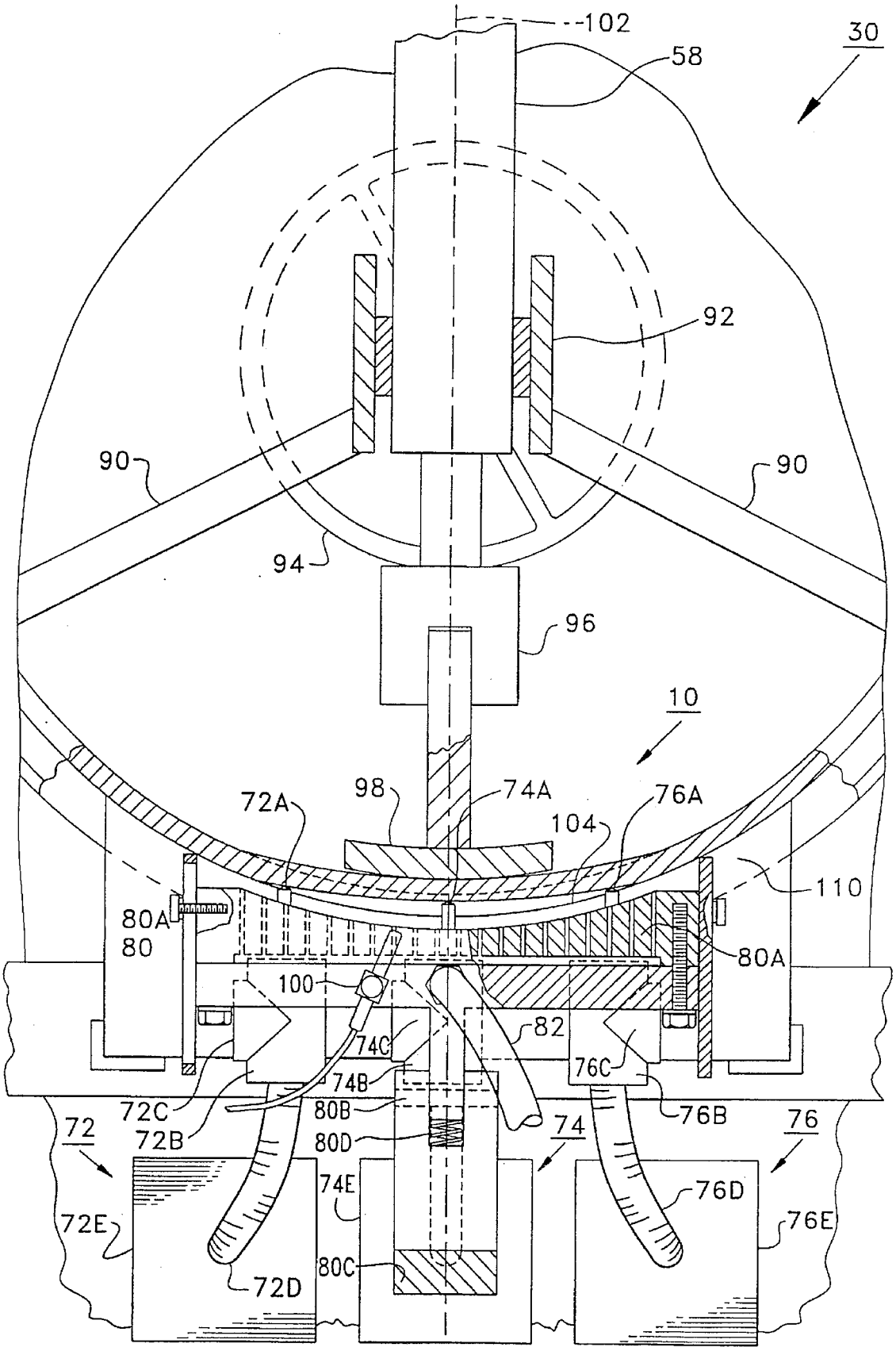
FIG. 4 is a view, taken along line 4—4 of FIG. 3, illustrating further details of the machine illustrated in FIG. 3.
Figure 5:
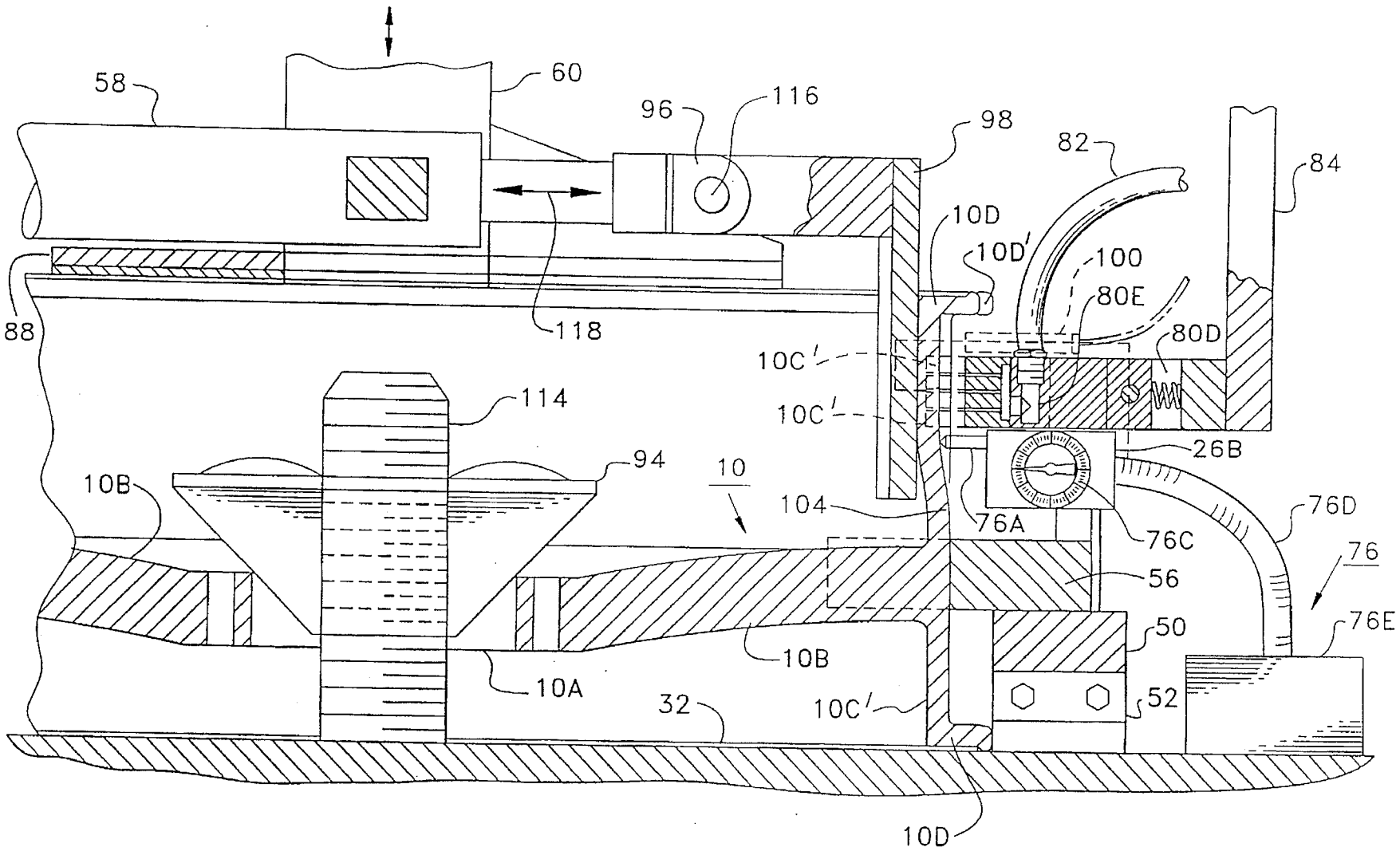
FIG. 5 is a view, taken along line 5—5 of FIG. 3, illustrating further details of the machine illustrated in FIG. 3.

Having said the above, the wheel straightening process performed in Stations 3 and 4 will now be discussed. The operation of Station 3, which is of particular importance to the present invention, may be described with reference to FIGS. 3–5. In general, FIGS. 3–5 illustrate a wheel straightening machine 30. This machine comprises a support table 32 upon which a damaged wheel is rigidly held in position at a predetermined location. Machine 30 also comprises a measuring means positioned at the predetermined location, and means for applying heat to the rigidly-held wheel so as to cause the temperature of the wheel to rise so that the wheel is transitioned into its somewhat softened state. Further included in machine 30 is a means for radially applying a suitable pressure to a wheel's damaged zone so as to urge this damaged zone outward; thus returning the wheel to its nominal-true condition.

Machine 30 also comprises a main support frame 34 and supporting members 36, 38, 40, 42, 44 and 46. Attached to support frame 34 is a rear restraining bar 48. An adjustable front restraining support bar 50 is secured to support table 32 via adjustment means 52 and 54.

Moreover, machine 30 includes a restraining bar 56 which is designed to abut against the outer region of the wheel's web portion to serve as a fulcrum. The function of restraining bar 56 will be better understood when the operation of machine 30 is discussed.

Secured to support frame 34, via hydraulic cylinder 60 and structural housing 90 and 92, is rim clamp 88. Rim damp components 60, 88, 92 and 90 are designed to exert a downward pressure on the damaged wheel.

Attached to structural housing 92 is a radial hydraulic press cylinder 58. A radial wheel straightening tool 98 is attached to radial hydraulic press cylinder 58 via coupling means 96 and pin 116. The function of the radial press hydraulic components will be better understood when reading the operation of machine 30 set out below.

The means for heating the damaged portion of the wheel includes flame head assembly 80 and gas supply tube 82. Flame head assembly 80 is attached to supporting member 38 via adjustable flame head mounting arm 84. Flame head mounting arm 84 can be adjusted via adjustable means 86.

Extending up from support table 32 is screw member 114. The wheel being repaired is placed over screw member 114. Thereafter, locking nut 94 is screwed onto screw member 114 until the outer surface of locking nut 94 contacts the wheel being prepared such that it firmly holds the wheel to support table 32.

In the embodiment illustrated in FIGS. 3–5, an automated system is employed. This automated system includes control panel 62 and has a plurality of operator indicator lights 64 thereon. Also included on control panel 62 is a hydraulic pressure gauge 66 which monitors the pressure generated by the rim clamp cylinder. Similarly, control panel 62 also has hydraulic pressure gauge 68 thereon which monitors the pressure exerted by the radial press cylinder.

There is also a temperature gauge 70 included on the control panel 62. Temperature gauge 70 is connected to temperature sensor 100 which monitors the temperature at the front edge of the flame head assembly 80.

Machine 30 further includes a plurality of measuring gauges 72, 74 and 76 which are used to determine the extent of the damage and the extent of the repair imparted thereon. An explanation of the positioning of these measuring gauges, and the manner in which they function, will be described below when discussing the operation of machine 30.

As indicated above, machine 30 is design to restore a damaged wheel to its nominal-true condition, as opposed to its final-true condition. The manner in which this can be achieved will be better understood when discussing the operation of machine 30 in relation to a specifically damaged wheel 10.

In operation, the damaged wheel 10 is placed onto table 32 with its damaged zone facing outward and located at a predetermined location corresponding to the general location of the front restraining bar 56 and the flame head assembly 80. The positioning of the flame head assembly 80, relative to the damage zone, may be further described with reference to FIG. 4 which is a view of machine 30 taken along line 4—4 of FIG. 3.

FIG. 4 illustrates the flame head assembly 80 as having a plurality of flame heads $80A_1 \ldots 80A_n$, a cavity 80B, a mounting arm clevis 80C, and a compression spring 80D. Spring 80D applies a constant force to the flame head assembly, while simultaneously allowing for the flame heads to move backwards, or to be retracted if the flame head assembly is inadvertently contacted by the wheel 10 as it is being positioned into the machine 30.

Temperature sensor 100 is arranged so as to measure the temperature at the front edge of the flame head assembly 80. Temperature sensor 100 cooperates with other means so that the gas supplied to flame head assembly 80 through tube 82, is terminated when the temperature at the front edge of flame head assembly 80 reaches a predetermined value. This value is a temperature which results in the damaged portion of the wheel being heated to its somewhat softened state.

The outer surface of flame head assembly 80 has a curved contour, similar to the contour of the outer surface of wheel 10. The central region of flame assembly 80 is positioned relative to the center line 102 of machine 30. Similarly, measuring gauge assemblies 72, 74 and 76 are also positioned relative to the center line 102.

Each of the gauge measuring means assemblies 72, 74 and 76 has an extending arm member, a housing, an indicating device, a flexible cable and a magnetic base represented by the letters A, B, C, D and E, respectively. Moreover, each of the measuring gauge assemblies also has movable means, in particular, the extending arm that indicates an initial preselected setting corresponding to the known (non-true) damage zone of the wheel and a final setting indicating the known (nominal-true) condition of the damage zone. These initial and final settings are predetermined and are established relative to the predetermined location of wheel 10 within machine 30.

For example, wheel 10 can be placed on machine 30 so that the central portion of its damaged zone (i.e., dz and rr of FIG. 1) is substantially located at the machine's center line 102. The damaged zone is indicated in FIG. 4 by a cross hatching of exterior of the wheel, whereas the nominal-true condition of wheel 10 is indicated, in part, by showing its inner diameter with a phantom line 10'. The damaged zone of wheel 10, in particular its length, is shown to substantially extend from the center line 102 in both directions (106 and 108) and corresponds to the accumulated distance covered by dimensional lines 106 and 108. As shown in FIG. 3, the tool 98 is positioned so that its central region also lines up with the machine's center line 102.

After the damaged wheel is positioned at the predetermined location of machine 30, the central region of center gauge 74 is positioned to substantially correspond with center line 102. Moreover, its movable member 74A is positioned to contact the central portion of the damaged zone of wheel 10.

Movable member 74A extends past the machine's outer surface 104 by a predetermined amount. This predetermined amount corresponds to the radial runout (rr) recorded in the operation of Station 1.

Similarly, left gauge 72 is positioned at a location which corresponds to dimensional line 110. Dimensional line 110 extends laterally away from center line 102. In this particular example, distance 110 is approximately ⅔ of that of distance 106.

Further, movable member 72A contacts the deformed zone of the wheel and also extends past the machine's outer surface 104 by a predetermined amount.

Right gauge 76 is positioned in a similar manner as that of left gauge 72 so as to be positioned at a location that corresponds to a distance 112. Again, in this particular example, distance 112 is approximately ⅔ of that of distance 108. Further-more, as with its counterpart, gauge 76 has a movable member 76A that contacts the deformed zone of the wheel and extends past the machine's outer surface 104 by a predetermined amount.

The operation of machine 30 is designed to restore the damaged zone of the wheel to its nominal-true condition. The manner in which this occurs may be further described with reference to FIG. 5, which is a view of machine 30 taken along the line 5—5 of FIG. 3. Specifically, FIG. 5 illustrates wheel 10 having its central region positioned over a screw member 114. Wheel 10 is held in a predetermined location on table 32 by coupling member 94.

For the purpose of this discussion, the wheel will be considered as being constructed of a lug portion 10A, a web portion 10B, a rim portion having an upper portion 10C1 and a lower portion 10C2, and an annular tire bead portion 10D. Lug portion 10A is the central area of the wheel that extends from the center of the wheel to an area just beyond the lug receiving holes of the wheel. Lug portion 10A resists strains or dents because it is held by the lug bolts or nuts in firm contact with the drum assembly of the automobile.

Web portion 10B interconnects lug portion 10A with rim portion 10C. Due to its structure and location, web portion 10B hardly ever experiences dent conditions.

However, rim portions 10C1 and 10C2, as well as tire bead portion 10D, commonly experience dents and bends. Rim portions 10C1 and 10C2 are cylindrically channel-shaped members upon which a tire is mounted. Tire bead portion 10D abuts up against, and holds, the mounted tire in position on the rim.

FIG. 5 illustrates the initial (non-true) condition of wheel 10 having a damaged zone encompassed by the upper bent, rim portion 10C1 and by the tire bead portion 10D. Conversely, FIG. 5 also illustrates (shown in phantom) the final (true) condition of wheel 10 with the damaged zone removed. When the damaged zone is removed, upper rim portion 10C1' is straight and wheel bead portion 10D' is also straight. The transition of wheel 10 from its non-true condition to its true condition is determined, in part, by gauge assemblies 72, 74 and 76.

As illustrated in FIG. 5, gauge extending arm 76A is set to extend past the outer surface 104 of machine 30 by an amount corresponding to the radial runout of the damaged zone. This runout setting is visually displayed on dial 76C. This runout setting also corresponds to the distance that arm 76A outwardly extends past the outer surface of restrainer bar 56, shown as abutting against the outer region of web portion 10B that interconnects rim portions 10C1 and 10C2. Restraining bar 56 serves as a fulcrum that cooperates with the urging of the damaged zone to return it to its nominal-true condition.

The initial preselected setting of arm 76A contacts the deformed damaged zone of the rim portion 10C1 and will be moved by the action of cylinder 58 to its final predetermined setting corresponding to the outer surface of the nominally-true condition of the rim portion 10C1', shown in phantom. The rim portion is urged to its nominally-true condition in response to a suitable pressure created by radial press hydraulic cylinder 58.

This urging can result after, or simultaneously with, the heating process. Preferably, the urging does not occur until after the damaged portion of the wheel is heated to its somewhat softened state.

Any suitable pressure can be used to urge the heated rim to its nominally-true condition. The preferred pressure will depend, in part, upon the temperature to which the damaged portion of the wheel is heated. In most instances, the pressure exerted by cylinder 58 ranges from between about 200 to about 6,000 pounds of force. Typically, this pressure ranges from between about 3,000 to about 5,000 pounds of force.

The pressure exerted by cylinder 58 is transferred to rim portion 10C1 by means of coupling member 96 which is connected to tooling member 98. Coupling member 96 and tooling member 98 are connected together by means of pin 116. The applied lateral force is shown in both its forward (outward) and reverse (inward) directions by means of a bilateral arrow 118.

In a preferred method of operation, rim damp plate 88, radial press hydraulic cylinder 58 and rim clamp hydraulic cylinder 60 are all first placed in their retracted positions. Wheel 10 is then placed on the table 32 with its damaged zone positioned in a central region 102 where flame assembly 80 is located. Wheel is then rigidly held in place by screwing coupling member 94 down onto screw arrangement 114 until member 94 firmly contacts wheel lug portion 10A.

Rim clamp hydraulic cylinder 60 is then actuated so that rim damp plate 88 presses downward onto wheel 10. This further ensures that wheel 10 is rigidly held at its predetermined location.

Front restraining bar 56 is also adjusted to restrain itself against the wheel's damaged zone. Tooling member 98, to be further described with reference to FIGS. **6*a* and 6*b*, is selected to match the contour and length of the damaged zone. The knuckle member 96 of radial press 56 is fitted with the selected tooling member 98. Radial press 56 is then actuated so as to bring tooling member 98** into contact with the wheel's damaged zone.

Heat is then applied to the damaged zone at specified temperatures for specified times until the rim temperature of the damaged portion of the wheel is within a range which facilitates the straightening process. Specifically, heat should be applied until the wheel's damaged portion is in its somewhat softened state. For example, if the wheel being repaired is made from an aluminum alloy, the damaged zone of the wheel is raised to a temperature within the range from between about 200° F. to about 700° F., preferably from between about 400° F. to about 600° F.

The heat is applied to the wheel's damaged portion for a duration of time typically ranging from between about 1 to about 20 minutes, typically from between about 1 to about 10 minutes, and normally from between about 2 to about 5 minutes. The amount of gas used for this heating, and all other heating, is controlled, in part, by the selection of the orifice of valve 80E.

For the embodiment of this invention illustrated in FIGS. 3, 4 and 5, a laterally extending outward constant pressure is exerted by radial press hydraulic cylinder 58 which, in turn, urges the damaged zone from its deformed (non-true) condition back into its original nominal-true condition. The motion of the radial press by hydraulic cylinder is preferably accomplished in a slow and a uniform manner. This radial pressing outward action may be applied several times so as to urge the damaged zone back into its nominal-true condition. The number of times the radial pressing is repeated is based upon the size and depth of the damaged zone. The transition from the damaged condition to the restored condition, is indicated when all of the gauges 72, 74 and 76 return to their initial or zero setting.

In another embodiment related to a computer controlled process to be further described later, the application of the radially-outward force may be in a progressive manner, starting with an initial amount to urge the damaged zone outward. Thereafter, the outward pressure can be sequentially decreased as the damage zone approaches its desired nominal-true condition.

The operation of the machine 30, as well as the computer controlled process, normally leaves a small amount of runout (e.g., from between about 1 to about 50 mils) in the damaged zone. Moreover, flat spots that may occur within in the damaged zone are normally not pressed out completely so as to avoid the creation of any corresponding high spots that may lead to rupturing of the restored surface.

Figure 6B:
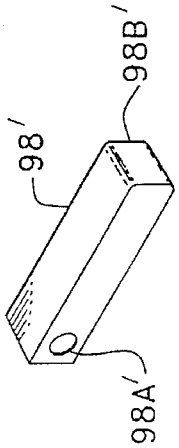
Figure 6A:
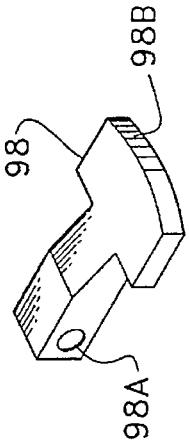

Examples of tooling members which can be used when practicing this invention are illustrated in FIGS. 6*a* and 6*b*. It should be noted, however, that those skilled in the art would know that these are merely illustrative examples of tooling members as opposed to limiting examples.

Referring now to FIGS. 6*a* and 6*b*, two examples of tooling members, 98 and 98' are illustrated, respectively. Tooling members 98 and 98' each have an opening 98A and 98A', respectively, which accommodates their coupling to the knuckle member 96 of piston 58 by means of pin 116.

The tooling member 98 of FIG. 6*a* has a face 98B that is contoured to match the inner diameter of the wheel 10. On the other hand, tooling member 98' as shown in FIG. 6*b*, has a blunt face 98B' that accommodates the straightening of small damaged zones of the wheel 10.

When practicing this invention, the appropriate tooling member should have a contour which closely matches the contour of the wheel's damaged zone. This enables the operator to restore the damaged zone to its nominal-true condition. However, the restoration of the damaged zone to its final true condition is described with reference to FIGS. 7 and 8. These Figures pertain to a machine 130, and correspond with Station 4 of Table 1.

In general, wheel straightening machine 130 has a rotating means with a mandrel to which the deformed wheel is clamped and attached. Machine 130 also has at least one pair of rollers oppositely positioned and spaced apart from each other so as to continuously contact and compress opposite sides of the damaged zone of the rotating wheel until the damaged zone is transitioned from its nominal-true condition to its final-true condition. Machine 130 includes a means for applying heat to the wheel in a controlled manner, a means for preselecting an initial setting of the allowable radial runout to which should remain in the wheel, and a means for deterinining the final setting when the rotating wheel has been returned to its final true condition.

In one particular embodiment of this invention, the rollers are arranged so that one is on top of the wheel's rim and two are below the wheel's rim. The rollers which are below the wheel's rim are positioned such that they straddle the top roller. These rollers are first located at the wheel lip adjacent to the damaged zone such that the damaged zone is centered at the flame assembly. The heat cycle is then initiated. After the damaged portion of the wheel is heated to its somewhat softened state, or while it is being heated to that temperature, the top roller is moved downward to establish a predetermined compression of the wheel relative to the bottom rollers while the wheel is being rotated. In this particular apparatus, the damaged wheel and rollers are driven by a low rotation gear drive motor.

Machine 130 has a center line 132 and includes a low rotation gear drive motor 134. The outer casing of motor 134 is represented by item 136 and the housing of motor 134 is represented by item 138.

Motor 134 has a coupling means 140 which serves as a mandrel for mounting thereon a damaged wheel. A screw means 142 is interconnected to motor 134 and extends outwardly from coupling means 140. Nut means 144 is designed to be screwed onto screw means 142 and to rigidly hold a damaged wheel thereto.

As stated above, machine 130 has a first roller means 168, a second roller means 178 and a third roller means 182. Roller means 168, 178 and 182 are indirectly and adjustably attached to motor 134 via adjustment means 148, 150, 152A, 152B, 154, 156A, 156B, 158, 160, 162, 164 and 166. Specifically, item numbers 148, 150, 152A and 152B are adjustment means for mounting assembly 146. Moreover, items 154 and 156B are pivot adjustment means for mounting assembly 146. Item 156A is a height adjustment means for assembly 156. Item numbers 158, 160, 162, 164 and 166 are support members and/or bracing devices which ultimately interconnect the rollers 168 and 178 to the motor 134.

When employing machine 130 to practice this invention, the damaged wheel 10 is positioned onto machine 130 so that the lateral region of the rim 10C1 is positioned below upper roller 168 and above lower rollers 178 and 182. Preferably, that portion of the wheel's rim which needs to be repaired by machine 130 is initially positioned such that it is centered over the flame assembly.

FIG. 8 illustrates the second roller 178 as having a shaft 180, and the third roller 182 as having a shaft 184. The first roller means 168 is positioned above the wheel's rim and straddles the second and third rollers. FIG. 8 further illustrates that machine 130 also has a hydraulic cylinder means 186 which controls the position of roller 168 by guide channels 188 and 190. Moreover, machine 130 also includes a first micrometer 200 and a second micrometer 202. Micrometer 200 has an adjustable arm 200A. Similarly, micrometer 202 has an adjustable arm 200A which can be adjusted via adjustment means 204.

Also included on machine 130 is a flame assembly 206. As with machine 30, the flame assembly 206 of machine 130 is designed to heat the damaged portion of the wheel to a temperature which facilitates the straightening process (i.e., heating the damaged portion of the wheel to its somewhat softened state).

In the operation of machine 130, the first roller 168 is raised upward to its retracted position and the tire bead 10D is inserted into the machine's throat area 176. The first roller 168 is then lowered so as to contact the upper surface of the wheel adjacent to the wheel's damaged rim portion 10C1 which was straightened to its normally true shape by machine 30 in the operation of Station 3. The second and third rollers 178 and 182 are thereafter raised to contact the lower surface of the wheel adjacent to the wheel's damaged (nominally true) rim portion 10C1.

With this configuration, when wheel 10 is rotated, its damaged zone passes under the roller 168 and over rollers 178 and 182. All of the rollers flushly contract the wheel's rim portion 10C1. To allow for such contact, the assembly 146 may be raised upward or downward to accommodate different size diameter wheels. Further, the assembly 146 may be pivoted about pin 154 by means of adjustment member 156B.

More particularly, the assembly 146 carrying rollers 168, 178 and 182 should be oriented by means of adjustment screw 156B so that the roller 168 is perpendicular to the top surface of rim portion 10C1 and rollers 178 and 182 are perpendicular to the bottom surface of the rim portion 10C1. Upon such an orientation, the wheel 10 may encounter its final truing condition.

As shown in FIG. 8, wheel 10 is attached to screw 142 which, in turn, is attached to the shaft of low rotation gear drive motor 134. Cylinder 186 is activated. This, in turn, applies a downward pressure firmly holding roller 168 against the top surface of rim portion 10C1.

Flame assembly 206 is then positioned relative to the rim surface. Preferably, the wheel is initially positioned onto machine 130 such that its damaged portion is in line with flame assembly 206. Moreover, micrometers 200 and 202 are positioned relative to the rim surface 10C1 and to the machine's center line 132.

More particularly, FIG. 8 shows dimension line 208 that extends from the center line 132 to the inner circumference of rim portion 10C1. Dimension line 208 corresponds approximately to ½ of the diameter of wheel 10. Except for the known thickness of the rim portion 10C1, dimension line 208 serves as a reference to which micrometer arms 200A and 202A are set.

For example, if rim portion 10C1 was perfectly "true," micrometer 202A could be set to correspond to dimensional line 208 so that the most outward portion of its tip never contacts the under surface of the rim portion 10C1. However, if the micrometer arm would deflect 1 mil while the wheel is being rotated, then it can be concluded that the rim portion 10C1 deviates from "true" by 1 mil as it is being rotated.

Micrometer arms 200A and 202A are adjusted so as to correspond to a radial runout normally in the range from between about 0 to about 50 mils. Micrometer 200A is set for this runout amount so that it will come into contact with any protrusions that extend outward from the top surface of the rim portion 10C1 by an amount that exceeds the pre-set runout setting. Similarly, arm 202A positioned under the rim surface 10C1 is set for this runout amount and will only come into contact with a depression that extends outward from the bottom surface of the rim portion 10C1 by an amount that exceeds the pre-set runout setting. Both of these micrometers are positioned over the region of the damaged zone, and will contact the damaged zone as the wheel is rotated in a clockwise direction 210 or even in a counter-clockwise direction (not shown). Micrometers 200 and 202 may be positioned laterally at various locations along the rim portion 10C1 as indicated by micrometer arm 200A being shown in phantom (200A').

Upon the setting of micrometers 200 and 202, the positioning of flame assembly 206 is adjusted in a manner as described for flame assembly 80 of FIGS. 3, 4 and 5. Similarly, flame assembly 206 is operated to raise the temperature of the wheel, in particular, the temperature of the wheel's rim portion 10C1, so that it obtains its somewhat softened condition in a manner as described for flame assembly 80.

After the wheel is being heated to its somewhat softened state, or while it is being heated thereto, the wheel is rotated in the direction 210 whereby rollers 168, 178 and 182 contact, in a crushing and compressing manner, the wheel's damaged zone. This process continues until the damaged zone is transitioned from its nominally-true condition to its final-true condition. Preferably, the rotation process does not begin until the temperature of the wheel's damaged portion has been raised to its somewhat softened state by the flame assembly.

The embodiment of machine 130 illustrated in FIGS. 7 and 8 is especially useful for removing "high spots" or positive radial runout from the lateral region of rim portion 10C1. However, it is also within the purview of this invention to employ an alternative embodiment of machine 130. This alternative embodiment is illustrated in FIG. 9 and is represented by item number 130'.

Machine 130' is similar to machine 130. The major difference between these two machines is the positioning of their respective rollers. Specifically, the rollers for machine 130' are arranged so that two are located over the wheel's rim and one is located below the wheel's rim. This lower roller is centered between the two upper rollers.

Machine 130' is especially useful for removing "low spots" or negative radial runout from the lateral region of rim portion 10C1. When employing machine 130', its rollers are first located at the wheel lip adjacent to the damaged zone such that the damaged zone is centered at the flame assembly. The heat cycle is then initiated. After the damaged portion of the wheel is heated to its somewhat softened state, or while it is being heated to this temperature, the bottom roller is moved upward to establish a predetermined compression on the wheel relative to the upper rollers while the wheel is being rotated. In this particular apparatus, the damaged wheel and rollers are driven by a low rotation gear drive motor.

Except for the positioning of its rollers, machine 130' is substantially identical to machine 130. Accordingly, all item numbers associated with machine 130 correlate with the identical item numbers associated with machine 130'. Moreover, the operation of machine 130' is virtually identical to that of machine 130 except for the changes which would have to be taken into consideration due to the different roller configuration. It is respectfully submitted that one of ordinary skill in the art would know how to operate machine 130' after reviewing the drawings and the accompanying specification.

It should also be noted that it is within the purview of this invention for machines 130 and 130' to be the same machine. Under such circumstances, machine 130 can have an alternate roller assembly positioned at a different location. Moreover, machine 130 can be designed such that the positioning of rollers 168, 178 and 182 can be inverted.

Regardless of the roller configuration, machines 130 and/or 130' are designed to transform the damaged wheel from its nominally-true condition (function performed in Station 3) to its final-true condition (function performed in Station 4). This corresponds with Station 4 of the present invention.

The obtainment of this final-true condition is realized when micrometer arms 200A and 202A no longer experience any significant deflections.

In accordance with the practice of this invention, a wheel is deemed to be within its final-true condition if the deflection registered by micrometer arms 200A and 202A is less than about ±15 mils. Preferably, a wheel in its final-true condition should not register a deflection greater than about ±10 mils, and more preferably not greater than about ±7 mils.

After the attainment of this final-true condition, the wheel is removed from the machine 130 or machine 130' embodying Station 4 and, under certain circumstances, cooled in accordance with Station 4. If necessary, the wheel is then subjected to the functions performed in Station 5.

It should now be appreciated that the practice of the present invention provides for a process and straightening machine(s) primarily accomplished by Stations 3 and 4. Specifically, Station 3 straightens a deformed non-true wheel back to its nominally-true condition; and, Station 4 straightens the nominally true wheel to its final-true condition.

The process, as well as the machines of the present invention, provide heat to the damaged zone of the wheel so that the metal of the wheel is transitioned to its somewhat softened state. Then, while the metal is in this somewhat softened state, or while it is being heated thereto, a suitable pressure is applied which restores the damaged wheel to substantially its original true, roundness condition. This pressure can be laterally-extending as described when discussing machine 30, or in the form of a rotating compressive force as described when discussing machines 130 and/or 130'.

Although the present invention has been described with reference to visually displaying micrometers indicative of the initial (deformed) and final (true) conditions of the wheel, it should be recognized that other automated devices, such as pre-programmed computers that control peripheral equipment may be used in the practice of the present invention.

For example, with regard to the operation of Station 3, a computer may be adapted to control the application of heat by flame head 80 and the application of the lateral force by radial hydraulic press cylinder 58. More particularly, a computer controlled system may be used to control the nominal straightening of wheel 10, and may be adapted to sensing the arms of measuring assembly 72, 74 and 76 so that, when these arms are no longer contacting the wheel 10, the computer peripheral equipment senses such a non-contacting condition as being indicative that the damaged zone has been restored to its nominal-true condition. Upon such detection, the computer may remove the heat from the wheel, cause the radial press hydraulic cylinder to be retracted, and cause rim clamp hydraulic cylinder 60 to also be retracted, thereby, allowing wheel 10 to be removed from table 32.

As previously discussed, the computer controlled process may be provided so as to cause the radical pressure to create an initial force to initiate the urging outward of the damaged zone and, then, sequentially decreasing this initial force so that the outward radial force is decreased as the damaged zone approaches its nominally true condition. Such a progressively decreasing force helps ensure that the wheel is smoothly restored to its original true condition without encountering any rupturing of its restored surface.

With regard to the operation of Station 4, a computer may be pre-programmed to slowly cause the wheel, in particular, the damaged zone, to be rotated between the compressing rollers. When the torque/force exceeds a preset maximum based upon alloy and deformity amounts of the wheel, the wheel rotation is stopped, or reversed and the pressure applied by the wheel is decreased, or the wheel is moved away or urged away from it deformity so as to reduce the applied torque pressure. The applied torque pressure may be measured by a gauge that is adapted to provide an input signal to the computer, and which may be attached to the rotating wheel to provide appropriate torque and force measurements that are routed back to the computerized equipment. After the initial pass of the damaged zone between the compressing rollers and for a succeeding passes, softening temperatures for the damaged zone are again attained, and the wheel starts turning again.

When the micrometer measurement or readouts indicate that the maximum radial runout has been removed, the process is stopped. The hydraulic actuation pressure applied to the rotating wheel is operated on a preset curve, beginning with a small amount of pressure at the edges of the damaged zone and increasing to a maximum pressure at the center of the damaged zone. The process computer may have peripheral equipment that controls the application and removal of heat to the rotating wheel Furthermore, the computer, in response to the non-contacting of the micrometers with the rotating wheel, may cause the removal of the heat to the wheel, the termination of rotation of the wheel, and the release of the rollers contacting the surfaces of the rim portion. Upon such response, the wheel may be removed from Station 4.

It should now be appreciated that the practice of the present invention provides for manual, semi-automatic and automatic control of the process for restoring a damaged wheel to its nominally true condition, and then to its final true condition.

Furthermore, although the previously given description described machine 30 as being associated with one station (i.e., Station 3), and machines 130 and/or 130' as being associated with another station (i.e., Station 4), it should be realized that the practice of the present invention contemplates the merging of any two or more of these machines into one integrated machine, thereby, allowing for the two processes to be completed within one station.

The present invention may be embodied in other specific forms without departing from the spirit or essential attributes thereof and, accordingly, reference should be made to the appended claims, rather than to the foregoing specification, as indicating the scope of the invention.

That which is claimed is:

1. A process for straightening a damaged zone of a metal wheel comprising the steps of:

(a) determining the non-true condition of a damaged wheel including its radial runout, its lateral runout, and the length of its damaged zone;

(b) rigidly holding the wheel in a fixture;

(c) applying heat to the wheel in a controlled manner so as to raise the temperature of the wheel to its somewhat softened state;

(d) applying a suitable force to the damaged zone while the wheel is in its somewhat softened state so that said radial runout of the damaged zone is reduced to a first predetermined limit; and (e) rotating said wheel between at least a pair of oppositely positioned contacting and compressing rollers, while simultaneously applying heat to the wheel, said rotating continuing until said radial runout is further reduced to a second predetermined limit.

2. A process according to claim 1, further comprising the step of cooling said wheel after said radial runout has been reduced to said second predetermined limit.

3. A process according to claim 1, wherein said rollers are first compressed at a predetermined pressure upon first contacting the damaged zone having a central region and, then, are further compressed to a maximum pressure when the rollers contact the central region of said damaged zone.

4. A wheel straightening machine for metal wheels having a known non-true radial zone comprising:

(a) a fixture upon which said wheel rests, said fixture having means for rigidly holding said wheel so that said non-true radial zone is located at a predetermined position on said fixture;

(b) measuring means located at said predetermined position and having movable means that indicate an initial preselected setting corresponding to said known non-true radial zone and a final preselected setting indicative of a known nominal-true condition of the radial zone;

(c) means for applying heat to said wheel in a controlled manner while said wheel is being held in said fixture to raise the temperature of said radial zone to the wheel's somewhat softened state; and (d) means for radially applying a suitable pressure to said heated radial zone so that said measuring means moves from its initial setting to its final setting.

5. A wheel straightening machine according to claim 4, wherein said wheel comprises aluminum alloys, and wherein said wheel's surface temperature is raised to a value in the range from between about 200° F. to about 700° F.

6. A wheel straightening machine according to claim 4, wherein said means for radially applying pressure develops a pressure is in the range from between about 200 to about 6,000 pounds.

7. A wheel straightening machine according to claim 4, wherein said means for radially applying pressure comprises a hydraulic cylinder having a radially extending cylinder with a tool attached thereto having a contour selected to match the contour of said non-true radial zone, said tool abutting against the inner surface of said non-true radial zone, said means for radially applying pressure further comprising a bar located opposite to said tool and serving as means to restrain radially movement of said non-true radial zone.

8. A wheel straightening machine for metal wheels having a known non-true radial zone comprising:

(a) a fixture having rotating means, said fixture having means for rigidly attaching and holding said wheel to said rotating means, said wheel being rotated so that said non-true radial zone moves at a predetermined lateral location and in a predetermined manner;

(b) measuring means located so as to contact said predetermined location of said non-true radial zone, said measuring means having movable means that indicate an initial preselected setting corresponding to said known non-true radial zone and a final setting corresponding to a known final-true-condition of said radial zone;

(c) means for applying heat to said wheel in a controlled manner while said wheel is being rotated so as to raise the temperature of said wheel's radial zone to the wheel's somewhat softened state;

(d) at least a pair of compression rollers oppositely positioned and spaced apart from each other so as to continuously contact opposite sides of said rotating wheel until said non-true radial zone is restored to its final true condition.

9. A wheel straightening machine according to claim 8, wherein said wheel comprises aluminum alloys, wherein said temperature is raised to a value in the range from between about 200° F. to about 700° F.

10. A wheel straightening machine for metal wheels having a damaged zone with a known radial runout, known lateral runout and a known length, said damaged zone constituting a known non-true radial zone, and said machine comprising:

(a) a first fixture upon which said wheel rests, said fixture having means for rigidly holding said wheel so that said non-true radial zone is located at a predetermined position on said fixture;

(b) first measuring means located at a first predetermined position and having movable means that indicate an initial preselected setting corresponding to said known non-true radial zone and a final preselected setting indicative of a known nominal-true condition of the radial zone;

(c) means for applying heat to said wheel in a controlled manner while said wheel is being held in said fixture to raise the temperature of said radial zone to the wheel's somewhat softened state;

(d) means for radially applying a suitable pressure to said heated radial zone so that said measuring means moves from its initial setting to its final setting;

(e) a second fixture having rotating means and adapted to receive said wheel having the final preselected setting from the first fixture, said fixture having means for rigidly attaching and holding said wheel to said rotating means, said wheel being rotated so that said non-true radial zone moves at a predetermined lateral location and in a predetermined manner;

(f) second measuring means located so as to contact said predetermined location of said non-true radial zone, said second measuring means having movable means that indicates an initial preselected setting corresponding to said known nominally true condition of the radial zone, the final preselected setting from the first fixture, and a final setting corresponding to a known final true condition of said radial zone; and (g) at least a pair of compression rollers oppositely positioned and spaced apart from each other so as to continuously contact opposite sides of said rotating wheel until said nominally true condition of the radial zone is restored to its final true condition.

* * * * *

UNITED STATES PATENT AND TRADEMARK OFFICE

CERTIFICATE OF CORRECTION

PATENT NO. : 5,634,361
DATED : June 3, 1997
INVENTOR(S) : George J. Herschman et al It is certified that error appears in the above-identified patent and that said Letters Patent is hereby corrected as shown below:

Col. 3, line 1, "gate" should be --state--.

In Figure 2 of the Drawings, correction is required for the following:

the caption for "Station #2" should read --PREHEAT WHEEL-- and the caption for Station #5 should read --COOLING WHEEL--.

In the Drawings:
Please delete FIG. 2 and replace with the attached corrected Fig. 2.
as shown on the attached page.

Signed and Sealed this

Third Day of February, 1998

*Attest:*

Bruce Lehman

BRUCE LEHMAN

*Attesting Officer*

*Commissioner of Patents and Trademarks*